United States Patent [19]

Cheng

[11] Patent Number: 4,838,224

[45] Date of Patent: Jun. 13, 1989

[54] METHOD AND APPARATUS FOR CONTROL OF ENGINE IDLING CIRCUIT

[76] Inventor: Huan-Sung Cheng, No. 222, I-Ming Rd., Ping-Tzeng Hsiang, Tao Yuan, Taiwan

[21] Appl. No.: 71,511

[22] Filed: Jul. 9, 1987

[51] Int. Cl.[4] ..... F02M 3/045; F02M 3/00

[52] U.S. Cl. ..... 123/339; 123/438; 261/41.5; 261/DIG. 74

[58] Field of Search ..... 123/339, 438, 325; 261/41.5, 44.5, DIG. 74

[56] References Cited

U.S. PATENT DOCUMENTS

| | | | |
|---|---|---|---|
| 3,554,173 | 1/1971 | Masaki et al. | 123/339 |
| 4,198,356 | 4/1980 | Takimoto | 261/41.5 |
| 4,217,313 | 8/1980 | Dmitrievsky et al. | 261/DIG. 74 |
| 4,268,462 | 5/1981 | Ota et al. | 261/DIG. 74 |
| 4,454,080 | 6/1984 | Acosta | 261/41.5 |
| 4,630,581 | 12/1986 | Shibata | 123/339 X |
| 4,630,585 | 12/1986 | Maraux | 123/438 |
| 4,674,460 | 6/1987 | Asmus | 261/41.5 X |

*Primary Examiner*—Willis R. Wolfe

*Attorney, Agent, or Firm*—Klein & Vibber

[57] ABSTRACT

A method and apparatus for controlling the idle circuit of a carbureted engine is disclosed. The apparatus includes a solenoid valve for blocking the idle circuit of a carburetor when engine speed exceeds a preset limit. Electronic circuits are disclosed to respond to engine speed and to activate the solenoid valve. The method disclosed involves interrupting the carburetor's idle circuit when engine speed exceeds a preset limit. In this fashion, fuel is conserved and air pollution is reduced.

10 Claims, 7 Drawing Sheets

METHOD AND APPARATUS FOR CONTROL OF ENGINE IDLING CIRCUIT

FIELD OF THE INVENTION

The invention relates to a circuit for controlling fuel consumption in an engine with a carburetor.

BACKGROUND OF THE INVENTION

Known engine carburetors contain an idling circuit which operates at starting and during idle speed of the engine, but is not needed during normal driving conditions. There are situations during normal driving conditions, however, when high vacuum pressure in the manifold drastically increases fuel consumption from the idling circuit even though the engine does not require extra power. Such situations include deceleration from high speed, driving on a downward slope, shifting gears, applying the brake, or releasing the accelerator pedal. In these cases, fuel is wasted and additional air pollution results.

It would therefore be advantageous to disable the idling circuit when the engine is running at speeds in excess of idle. If this is accomplished, fuel can be conserved, and air pollution minimized.

SUMMARY OF THE INVENTION

It is therefore an object of the present invention to provide a means for disabling the idling circuit of a carbureted engine to thereby conserve fuel and minimize air pollution.

The present invention accomplishes this object by a control circuit responsive to engine speed which activates a solenoid valve for blocking the idling circuit whenever engine speed exceeds a preset value.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENTS

The inventive concept of the present invention is illustrated herein by reference to three preferred embodiments, namely a tachometer controlled circuit, a high tension controlled circuit, and a platinum contact controlled circuit. Each circuit has the object of activating a solenoid valve in the idling circuit of a carburetor in accordance with engine speed.

Figure 1:
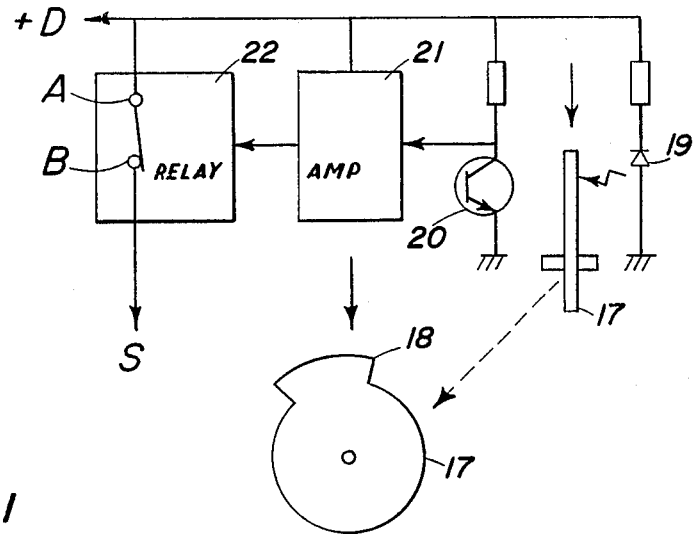
FIG. 1 is a schematic diagram of a closed circuit according to the invention under the control of a tachometer.
Figure 2:
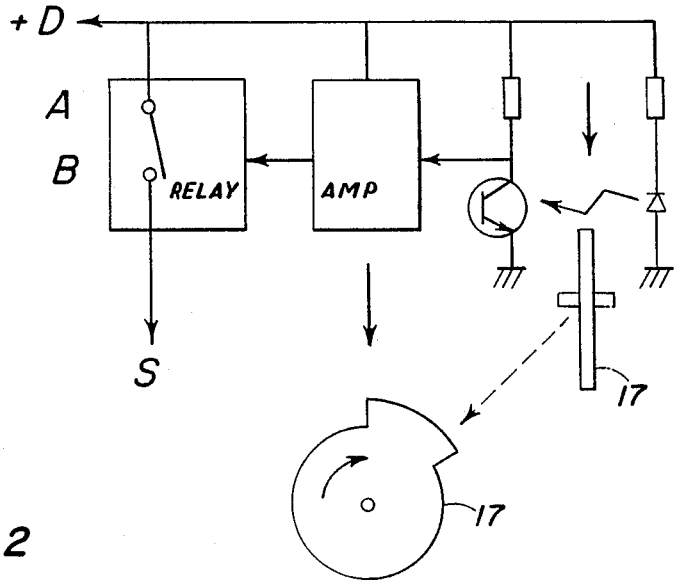
FIG. 2 is a view similar to FIG. 1, but showing an open circuit.

Referring generally to FIGS. 1 and 2, a tachometer controlled circuit includes a control plate 17 in the tachometer (not shown) which responds to engine speed, i.e. needle movement of the tachometer. The control plate has an extended portion 18 which block light transmitted by LED from being sensed by optical sensor 20. When the engine speed is below a preset value, the extended portion 18 of plate 17 blocks the sensor 20 and thereby (via amplifier 21) closes the contacts A and B of relay 22. When engine speed is higher than the preset value, the extended portion 18 of plate 17 is rotated out of position allowing light from LED 19 to reach sensor 20 which, via amplifier 21 causes relay 22 to open the A - B contact. See FIG. 2. The relay 22 controls power to the solenoid discussed in detail hereinbelow.

Figure 3:
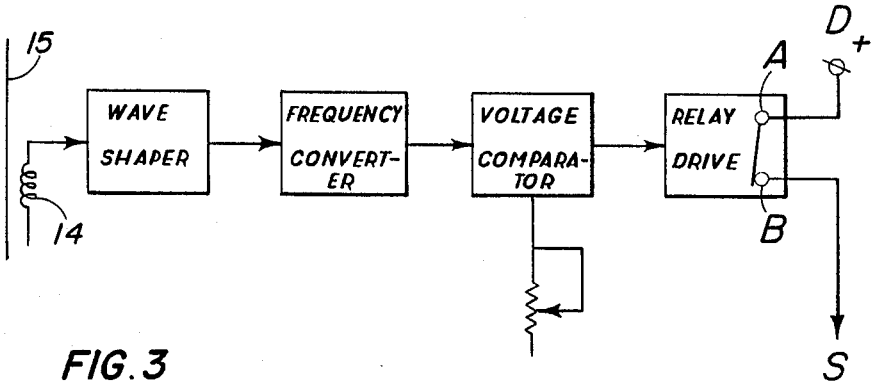
FIG. 3 is a schematic diagram of a closed circuit according to the invention under the control of the high tension wire of the engine's ignition system.
Figure 4:
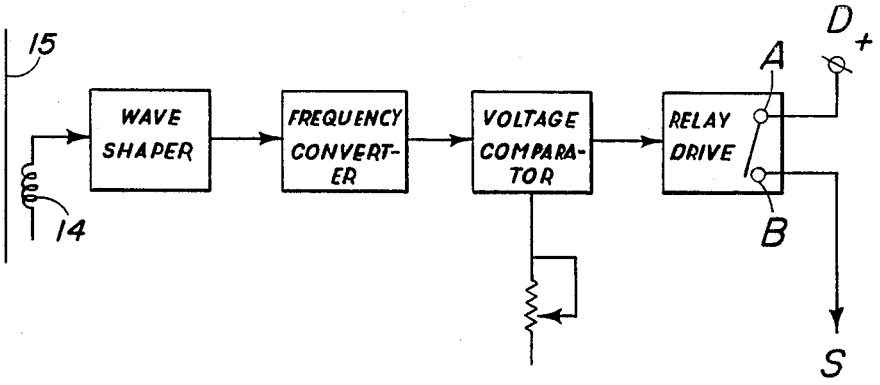
FIG. 4 is a view similar to FIG. 3, but showing an open circuit.

Referring now to FIGS. 3 and 4, a high tension wire induction-type controlled circuit includes a coil 14 installed on the high tension wire 15 of the engine's ignition coil. Thereby, a current is induced in coil 14 whenever high tension is present in wire 15. The induced signal results in a positive current when the engine speed is lower than a preset value and thereby closes the contact A - B by way of the circuit shown in FIG. 3. When the engine speed is higher than a preset value, positive current to the solenoid S is cut off as shown in FIG. 4.

Figure 5:
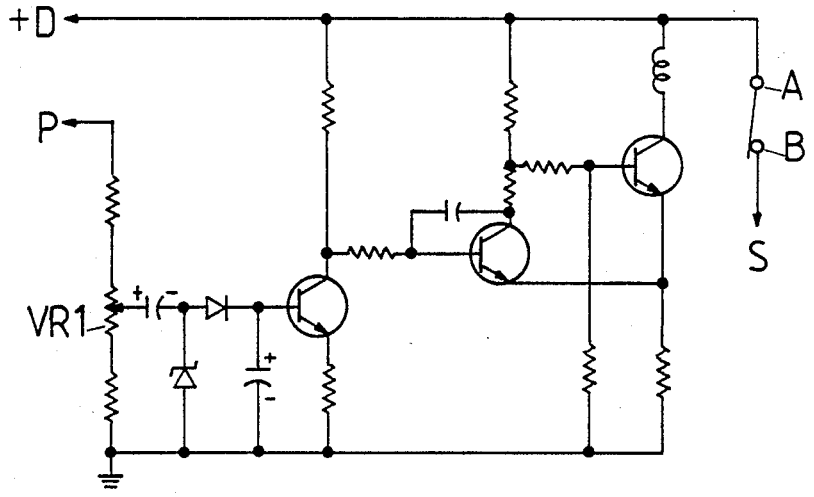
FIG. 5 is a schematic diagram of a closed circuit according to the invention under the control of the platinum contact of the engine's ignition system.
Figure 6:
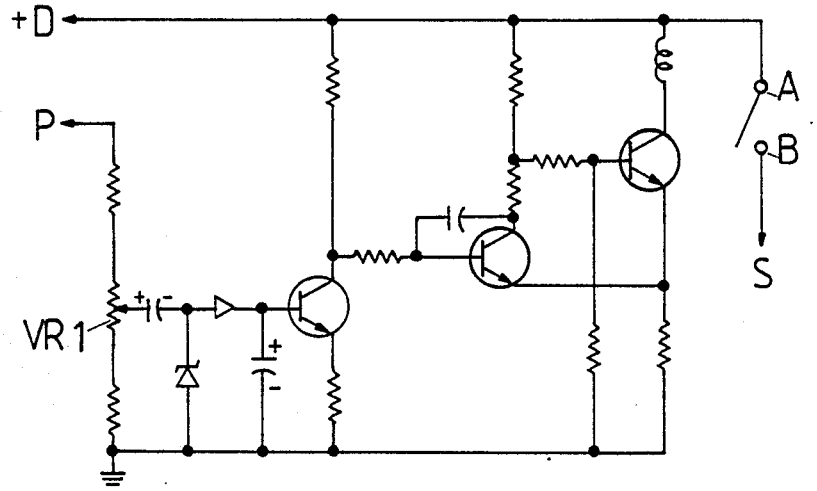
FIG. 6 is a view similar to FIG. 5, but showing an open circuit.

FIGS. 5 and 6 show a circuit for platinum contact control of solenoid S. This circuit utilizes the platinum contact P (negative terminal) of the engine's high tension ignition coil. The circuit provides positive current to solenoid S, when the signal supplied by the platinum contact is smaller than a preset value. When the engine speed is increased. the signal supplied by P reaches VR1, a preset value, and the circuit cuts off positive current to the solenoid valve S.

Figure 7:
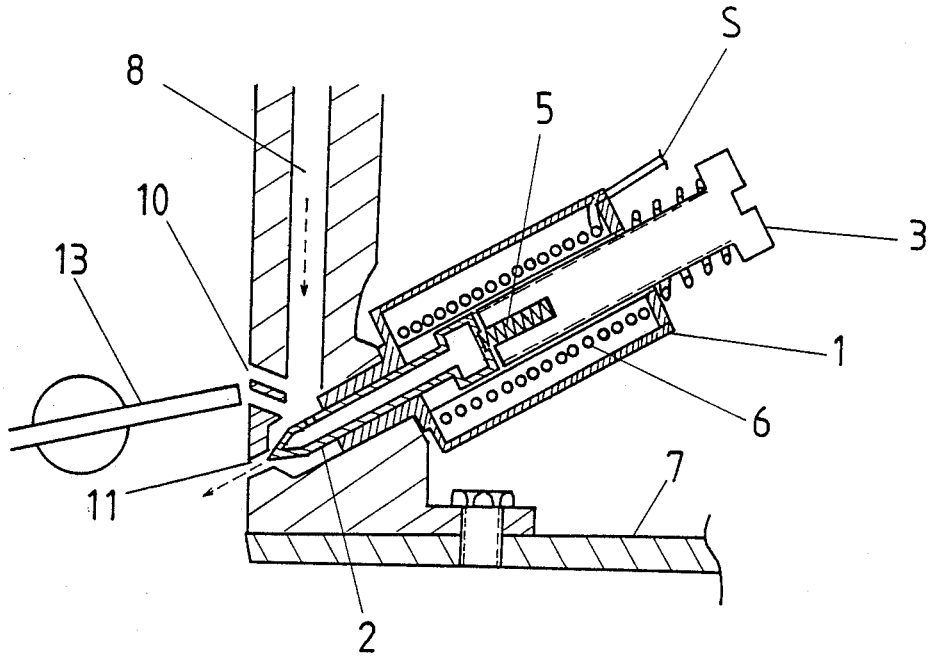
FIG. 7 is a cross sectional schematic view of the solenoid valve of the invention with the idling circuit enabled.
Figure 8:
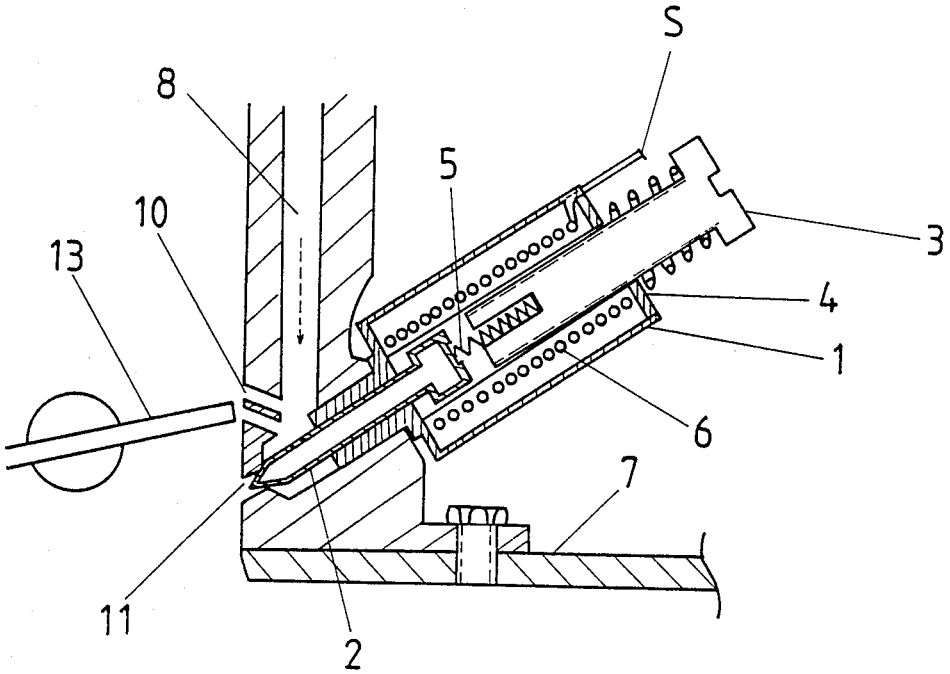
FIG. 8 is a cross sectional schematic view of the solenoid valve of the invention with the idling circuit disabled.

The idling solenoid valve according to the invention is shown by way of example in FIGS. 7 and 8. The valve is preferably installed at the passage of the idling circuit 11 of the carburetor, at the idle adjustment screw 3. When one of the circuits described above supplies current to contact S of coil 6, the adjusting screw 3, shown in FIG. 7, becomes magnetic and absorbs the spindle 2 so that there is no obstruction in the idling circuit. When the power to coil 6 is cut off, adjusting screw 3 is no longer magnetic and spindle 2 is pushed back in position by spring 5, as shown in FIG. 8. The gap between the spindle 2 and the idling nozzle 11 (FIG. 7) can be adjusted by screw 3, which serves as idle adjustment for the carburetor.

Thus, the solenoid valve keeps the idling circuit working when the power is on and disconnects the idling circuit when the power is off.

Figure 9:
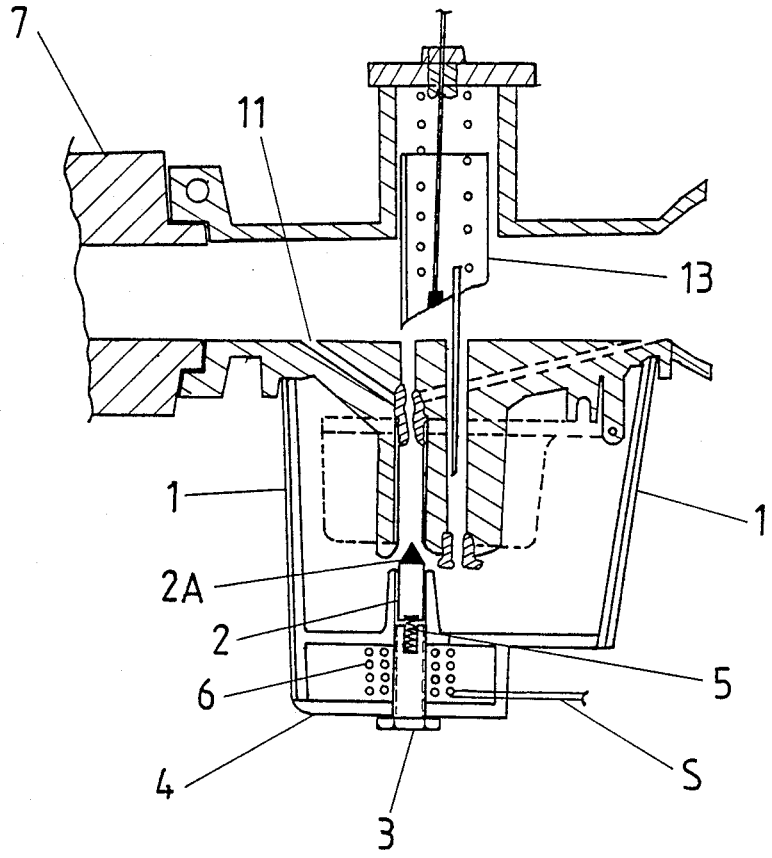
FIG. 9 is a cross sectional schematic view of an embodiment of the inventive solenoid valve suitable for installation in a motorcycle.

When the invention is in a motorcycle carburetor, an arrangement as shown in FIG. 9 can be used. In this embodiment an oil resistant rubber cap 2A can be provided on the tip of spindle 2 to enhance its sealing ability in blocking the idling circuit.

Figure 10:
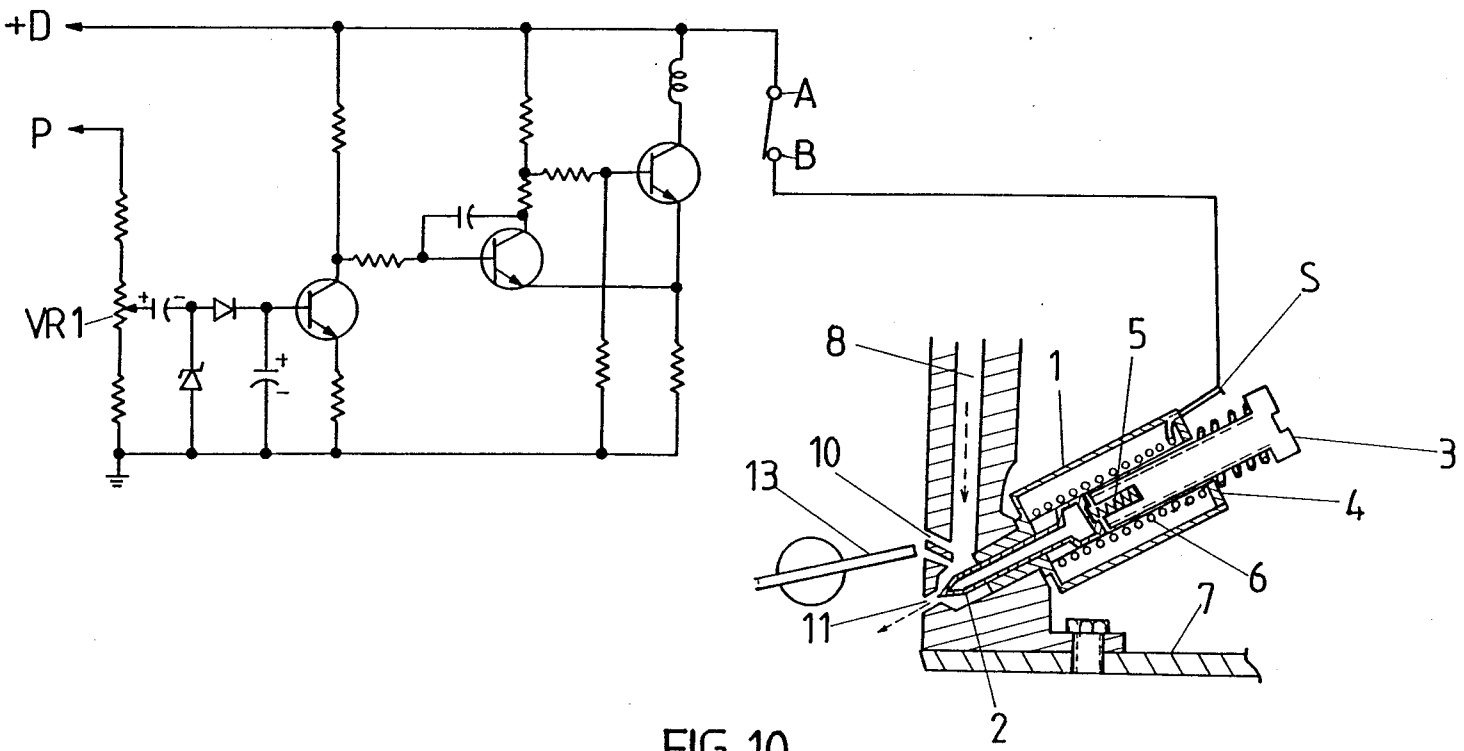
FIG. 10 is a view combining aspects of FIGS. 3 and 7.
Figure 11:
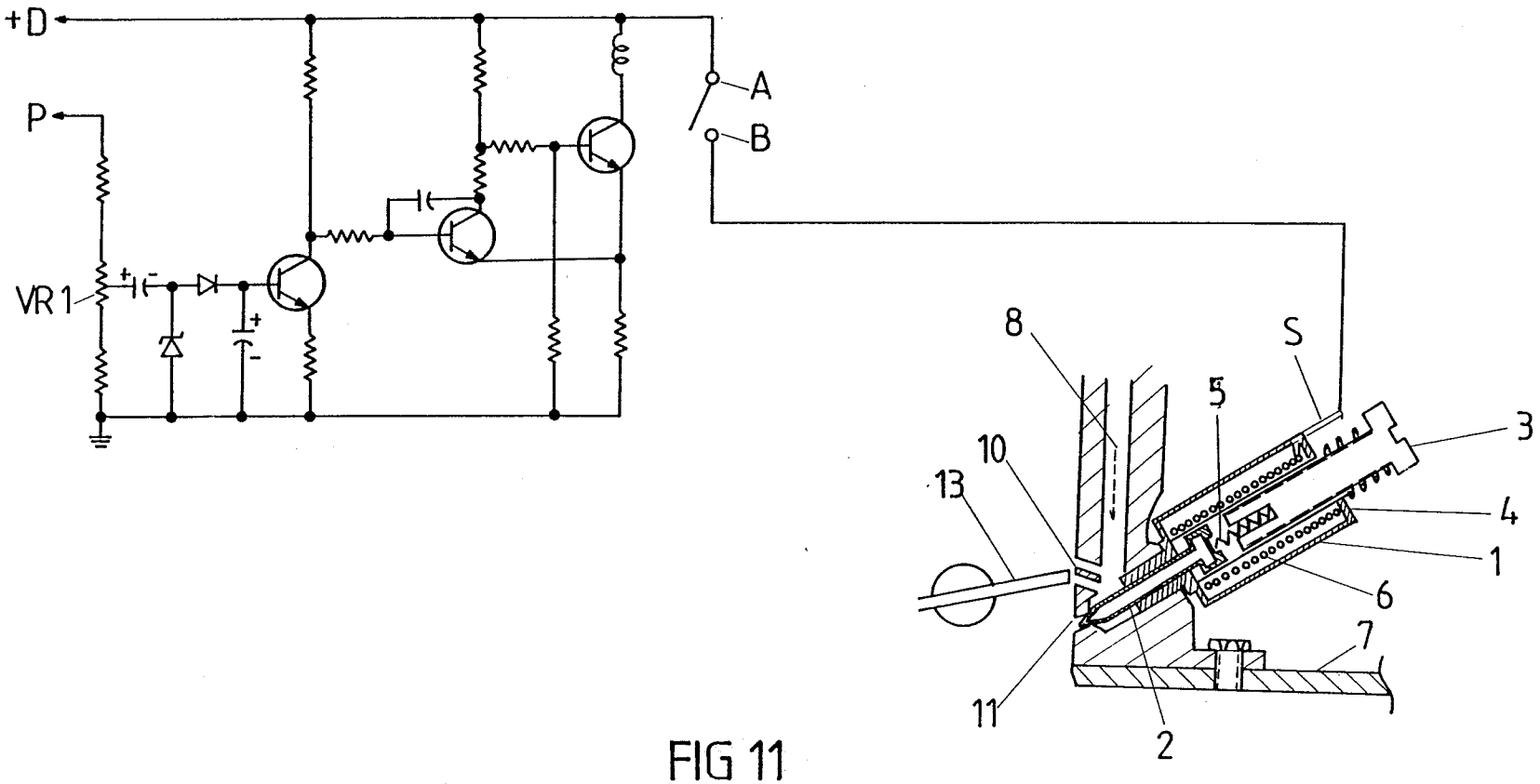
FIG. 11 is a view combining aspects of FIGS. 4 and 8.

A preferred embodiment of the invention, shown in FIGS. 10 and 11, operates as follows:

Idle speed can be set at 600 rpm and the preset value at which the solenoid is activated can be set for 1200 rpm. When the ignition switch is turned on, positive current flows from D to A, B, and then S. There is an induction in coil 6 and the adjusting screw 3 becomes magnetic and attracts the spindle 2 to maintain the idling circuit so that the engine may be started and idle at the set idle speed.

When the engine speed is increased, the signal provided by P eventually reaches a value corresponding to the preset value at VR1. When the signal at P exceeds the value preset at VR1, the relay operates to disconnect A and B and power to the solenoid valve is cut off. The adjusting screw is no longer magnetic and no longer attracts spindle 2. Spindle 2 is forced by spring 5 to close the opening 11 of the idling circuit of the carburetor (FIG. 11). Thereafter, as long as engine speed remains above this preset limit, no fuel will be absorbed through the idling nozzle regardless of the vacuum in the manifold.

When the engine speed slows down to below the preset limit, the signal at P falls below the level preset at VR1, the relay stops operating, and current is restored to coil 6. The idling circuit is restored to function and keep the engine running at normal idling speed.

Although the invention is described and illustrated with reference to a plurality of embodiments thereof, it is to be expressly understood that it is in no way limited to the disclosure of such preferred embodiments but is capable of numerous modifications within the scope of the appended claims.

I claim:

1. A method for controlling an idle circuit of a carburetor in an internal combustion engine comprising the steps of providing said carburetor with a solenoid activated valve whereby activation of said valve is necessary to complete the idle circuit of said carburetor;

providing means responsive to engine speed to activate said solenoid;

choosing a preset limit for engine speed, at which limit said solenoid will be deactivated;

constantly monitoring engine speed such that said means responsive to engine speed deactivates said solenoid when engine speed exceeds said preset limit and activates said solenoid when engine speed falls below said preset limit.

2. A method as claimed in claim 1 wherein said step of measuring engine speed is performed by a tachometer and said means responsive to engine speed is a mechanical shutter interrupting an optical signal.

3. A method as claimed in claim 1 wherein said step of measuring engine speed is performed by an induction means inductively coupled to a high tension wire of an ignition system of said engine and said means responsive to engine speed is an electronic circuit driving a relay.

4. A method as claimed in claim 1 wherein said step of measuring engine speed is performed by an electronic circuit driven by a negative pole of an ignition coil of an ignition system of said engine and said means responsive to engine speed is an electronic circuit driving a relay.

5. A method as claimed in claim 1 wherein said solenoid activated valve includes an idle adjustment screw with a spring loaded spindle, whereby when activating said solenoid said screw is magnetized attracting said spindle and withdrawing said spindle from an idling nozzle in said carburetor and when said solenoid is deactivated said spring load urges said spindle towards said nozzle.

6. An apparatus for control of an idle circuit of a carburetor in an internal combustion engine comprising a solenoid valve operatively arranged in the idle circuit of said carburetor, said solenoid valve being actuated by an electric current, whereby when said valve is actuated, said idle circuit is complete and when said valve is deactivated, said idle circuit is interrupted;

electrical relay means, serially connected between a coil of said solenoid and a power source;

engine speed measurement means, and signal means responsive to said measurement means, said signal means being adjustable to respond to said measurement means at a preset engine speed;

said signal means supplying said relay means with an actuating signal such that said relay means supplies power to said solenoid coil when said engine speed is below said preset engine speed and said relay interrupts power to said solenoid coil when engine speed exceeds said preset engine speed.

7. An apparatus as claimed in claim 6, wherein said engine speed measurement means is a tachometer and said signal means is an optical circuit interrupted by a mechanical shutter, said shutter driven by said tachometer.

8. An apparatus as claimed in claim 6 wherein said engine speed measurement means is an induction coil inductively coupled to a high tension wire of an ignition system of said engine and said signal means comprises a voltage comparator.

9. An apparatus as claimed in claim 6 wherein said engine speed measurement means is an electronic circuit driven by a negative pole of an ignition coil of an ignition system of said engine.

10. An apparatus as claimed in claim 6 wherein said solenoid valve includes an idle adjustment screw with a spring loaded spindle, whereby when activating said solenoid, said screw is magnetized attracting said spindle and withdrawing said spindle from an idling nozzle in said carburetor and when said solenoid is deactivated, said spring load urges said spindle towards said nozzle.

* * * * *